United States Patent [19]

Mills

[11] Patent Number: 4,552,197

[45] Date of Patent: Nov. 12, 1985

[54] MOULD ASSEMBLY FOR CASTING METAL ARTICLES AND A METHOD OF MANUFACTURE THEREOF

[75] Inventor: David Mills, Bristol, England

[73] Assignee: Rolls-Royce Ltd., London, England

[21] Appl. No.: 509,813

[22] Filed: Jun. 30, 1983

[30] Foreign Application Priority Data

Jul. 3, 1982 [GB] United Kingdom ..... 8219294

[51] Int. Cl.[4] ..... B22C 9/04

[52] U.S. Cl. ..... 164/34; 164/137; 164/339; 164/341; 164/361

[58] Field of Search ..... 164/34–36, 164/122.1, 122.2, 137, 339, 340–341, 361, 164/364–368; 264/221

[56] References Cited

U.S. PATENT DOCUMENTS

| | | | |
|---|---|---|---|
| 2,793,412 | 5/1957 | Lashbrook | 164/34 |
| 3,848,654 | 11/1974 | Boyle et al. | 164/137 |
| 4,043,379 | 8/1977 | Biazek | 164/23 |
| 4,066,116 | 1/1978 | Blazek et al. | 164/17 |
| 4,129,169 | 12/1978 | Biedacha et al. | 164/166 |
| 4,133,371 | 1/1979 | Birch et al. | 164/525 |
| 4,421,153 | 12/1983 | Wilkinson et al. | 164/34 |

FOREIGN PATENT DOCUMENTS

| | | | |
|---|---|---|---|
| 221868 | 9/1958 | Australia | 164/34 |
| 2651144 | 5/1977 | Fed. Rep. of Germany . | |
| 2900959 | 7/1979 | Fed. Rep. of Germany . | |
| 45-39342 | 12/1970 | Japan | 164/137 |
| 1093726 | 12/1967 | United Kingdom . | |
| 1135255 | 12/1968 | United Kingdom . | |
| 1346576 | 2/1974 | United Kingdom . | |
| 2012640A | 1/1979 | United Kingdom . | |
| 2028928A | 7/1979 | United Kingdom . | |
| 1584367 | 2/1981 | United Kingdom . | |
| 2096502A | 10/1982 | United Kingdom . | |
| 2096503A | 10/1982 | United Kingdom . | |

*Primary Examiner*—Nicholas P. Godici
*Assistant Examiner*—Richard K. Seidel
*Attorney, Agent, or Firm*—Parkhurst & Oliff

[57] ABSTRACT

The invention relates to a mould assembly including a plurality of individual moulds. The mould assembly of the present invention is made by separately transfer moulding a starter base 16, a plurality of moulds 12, a downpole 14 and pouring cup 19, providing each with mechanical locking features, such as screw threads, and joining them together into the assembly. Much greater flexibility is thereby achieved in materials and wall thicknesses, which can be different in different parts of the assembly to suit strength and heat transfer requirements, individual bits can be replaced, and the transfer moulding produces a compact homogeneous ceramic structure.

10 Claims, 9 Drawing Figures

MOULD ASSEMBLY FOR CASTING METAL ARTICLES AND A METHOD OF MANUFACTURE THEREOF

Figure 1:
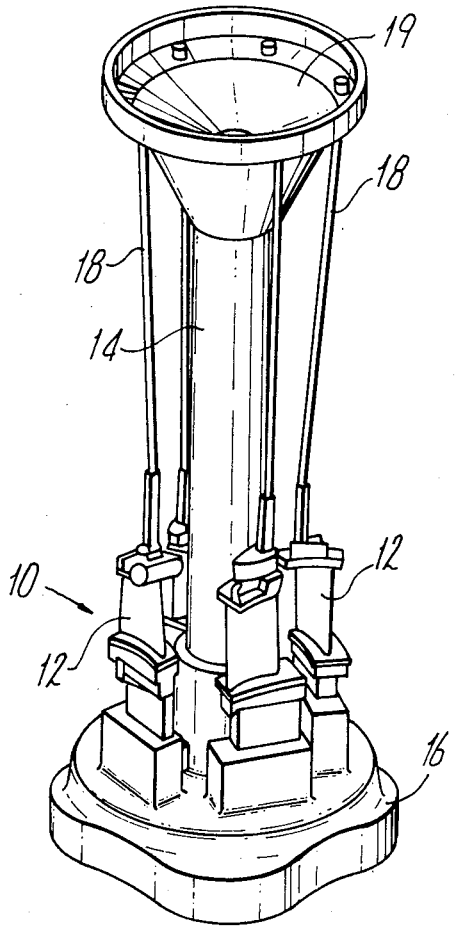

The present invention relates to a mould assembly for casting metal articles, and a method of manufacture thereof.

In a conventional lost wax process for making moulds, a wax pattern of the article to be cast is made and coated with ceramic by dipping into a liquid ceramic and stuccoing with ceramic particles. The dipping and stuccoing is repeated several times to build up the ceramic to provide adequate strength and adhesion. When the build up of ceramic is complete the mould is de-waxed and then fired to sinter the ceramic.

Complicated assemblies of individual moulds are made using this process, and the assemblies are made by joining together the wax patterns before the dipping and stuccoing stage because of the ease with which the wax parts can be joined. The assemblies usually include a common downpole which will, in the finished assembly, constitute the runner system for all of the moulds.

There are some drawbacks with this process, particularly when the mould assembly is to be used for casting directionally solidified articles including single crystal articles, for which the mould assembly is held at a higher temperature for considerably longer than in conventional casting.

One drawback is that the dipping and stuccoing process has to be repeated several times to produce a ceramic layer of the requisite strength. This process produces a layered structure in the ceramic and it is difficult to control the thickness of the ceramic layer. This can lead to cracking when the mould is heated for dewaxing or firing, particularly since the firing of a mould for directionally solidified articles must take place at temperatures of the order of 1500° C. It is also difficult with this process to provide different wall thicknesses in different parts of the mould assembly.

A further drawback is that the process produces an integral assembly of moulds with their runner and riser systems and, if any part has a flaw, the whole assembly is scrapped because of the possibility of the mould bursting when the molten metal is poured in.

Thus one object of the present invention is to provide a mould assembly and a method for its manufacture which avoids some or all of the above-mentioned drawbacks.

It is also known in the casting field, for example from U.S. Pat. No. 4,066,116, to join ceramic moulds together into an assembly with a cement. This process usually involves providing flanges on the moulds by means of which the moulds may be cemented together. These flanges have sometimes been coated with further ceramic material to give added strength, all of which leads to a significant change in local wall thickness of the mould which is a source of trouble when the mould is heated.

In addition, making provision for a cement layer reduces the dimensional accuracy of the mould which renders this method unsuitable for casting very accurate finished-size parts.

Another object of the invention is to provide a mould assembly which is fabricated from several components joined together without the use of flanges and cement between the parts.

According to the present invention a mould assembly comprises a plurality of ceramic component parts at least two of which are provided with a mechanical locking feature which co-operates with the feature on the other part either alone or with further means to lock the two parts together in the assembly.

The component parts of the mould may be made by any conventional means but are preferably made by an injection moulding technique.

Various forms of mechanical locking features are envisaged including screw threads, bayonet fittings or ceramic circlips fitting into grooves in two parts to be joined. The circlips are positioned while in a flexible state and are subsequently fired to complete the mechanical lock.

Figure 4:
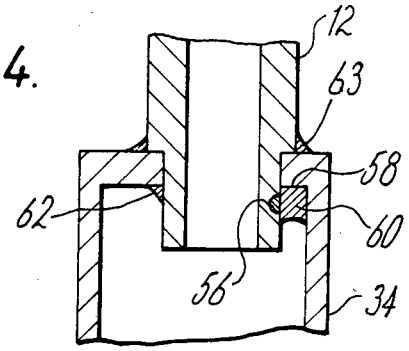
Figure 2:
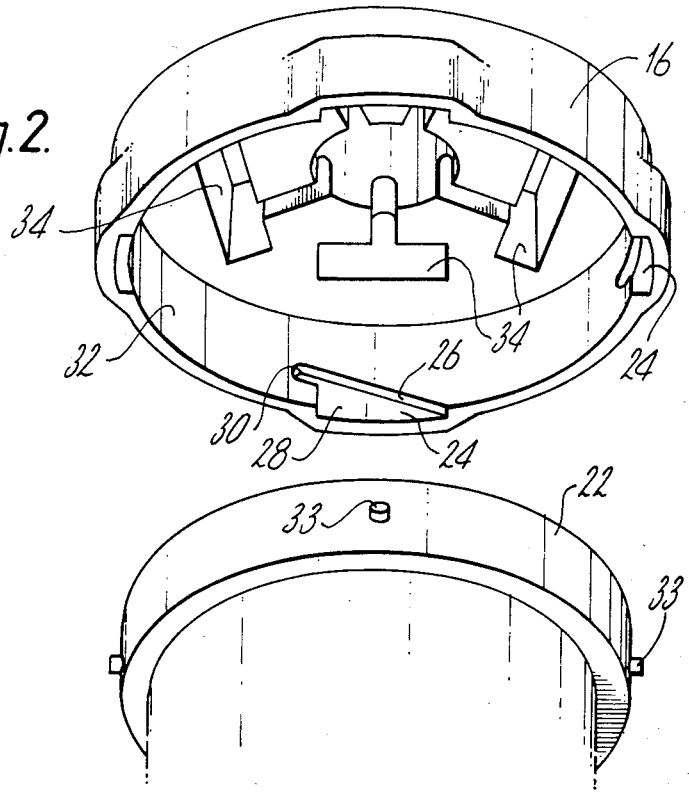
Figure 3:
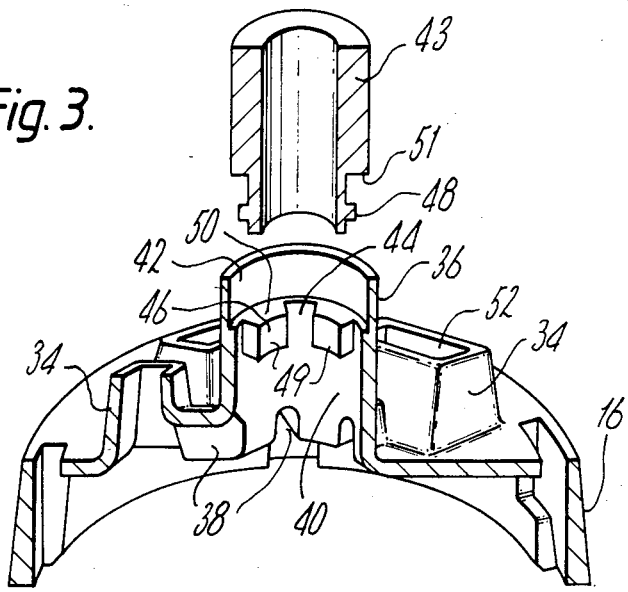

An example of the present invention will now be more particularly described with reference to the accompanying drawings in which:

FIG. 1 is a view of a completed ceramic mould assembly made in accordance with the present invention, and, FIGS. 2 to 4 show various component parts of the ceramic mould assembly, and, FIGS. 5 to 9 show steps in the method of making the individual moulds used in the assembly of FIG. 1.

Referring now to the drawings a mould assembly 10 for casting a plurality of gas turbine engine blades or vanes in directionally solidified form is shown to include a plurality of individual ceramic moulds 12, each having a casting cavity defining the shape of the blade, a common ceramic downpole system 14 for pouring metal, and a common ceramic base portion 16 which includes internal runner systems for feeding the individual moulds. A plurality of hollow ceramic tubes 18 are sealed into the tops of the moulds 12 and are slidably connected to the pouring cup 19 of the downpole system 14 to provide support for the individual moulds and to vent their interior. The sliding joint allows for thermal expansion of the tubes.

FIG. 2 shows an exploded view of a finished ceramic starter base portion 16 and a copper chill 22 for use in casting directionally solidified articles. The figure shows the underside of the ceramic starter base portion 16 from which it can be seen that it is formed with four recesses 24 having inclined surfaces 26. The recesses 24 have a relatively wide opening 28 on the bottom surface of the base, and terminate in a narrow blind slot 30 in the side wall 32 of the base portion 16. The recesses 24 provide mechanical locking features which are adapted and arranged to co-operate with pins 33 on the copper chill 22 in the manner of a screw thread, the inclined surfaces of the recess allowing the base 20 to be "screwed" onto and off the copper chill 22.

The base also includes starter cavities 34 which allow for columnar crystal growth to become established from the chill 22, or for crystal selection to take place before the crystalline growth reaches the casting cavity in the mould 12.

The ceramic starter base is transfer moulded in a die which defines the inner and outer shapes of the base and its thickness, the inclined recesses allowing the inner part of the die to be screwed out so that a seamless one-piece component can be produced to accurate dimensions. The ceramic is fired before assembly.

FIG. 3 is a sectional side-view of the starter base 16 which shows that the starter base also includes the bottom portion 36 of the ceramic downpole system 14 and defines runner cavities 38 from the downpole to the starter cavities. It can also be seen that the downpole portion 36 is provided on its inner surface 40 with a recess 42 to receive the lower part 43 of the downpole system 14, and mechanical locking features in the form of additional recesses 44 defining projections 46 which act as a type of bayonet fitting to receive and lock projections 48 on the lower part 43 of the downpole system 14. The lowermost surfaces 49 of the projections 46 are angled to ensure that as they are engaged by the projections 48 on the downpole part 43, a rotation of the downpole part will cause the downpole part to be pulled downwards to get good engagement and sealing between the faces 50 and 51 on the two components.

It can be seen from this figure that the top surfaces of the starter cavities 34 are apertured at 52 to receive the lower portion of the casting moulds 12. The method of mechanically locking the casting moulds to the starter cavities is shown in FIG. 4, from which it can be seen that each mould 12 has a hollow base portion 54 which is received in an aperture 52 of a starter cavity 34. The mechanical locking features on the mould base portion 54 and the starter base portion 16 are formed respectively by a recess 56 and a shoulder 58 which co-operate to define a space for receiving a ceramic putty or slurry indicated at 60. Once compacted into the space and fired, the ceramic, together with the recess 56 and shoulder 58, form a mechanical lock for retaining the casting mould, and act with further applications of putty or ceramic indicated at 62 and 63 to seal the two components against leakage of molten metal after pouring.

The downpole system 14 is preferably transfer moulded in ceramic and is fired prior to assembly. As seen in FIG. 1 it includes the pouring cup 19.

Figure 9:
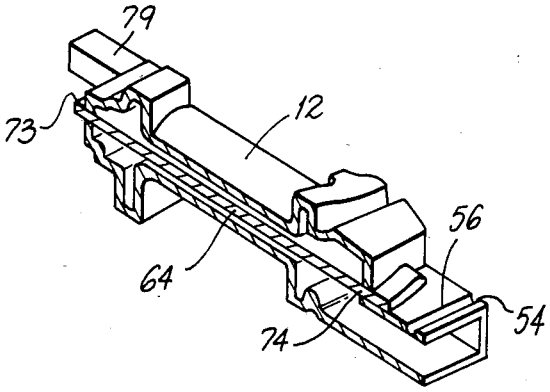

Turning now to the individual mould components, each is of the type illustrated in FIG. 9. Referring now to this Figure there is shown a ceramic mould 12 for casting hollow gas turbine engine blades which includes a core 64.

Although, once again such a mould could be made from a conventional lost wax process, a preferred method of manufacture is by transfer moulding of the ceramic in a die. The steps in the method are as follows:

Firstly the ceramic core 64 is transfer moulded and is cured to its "green state". The core is preferably made from a high strength ceramic such as alumina.

Figure 5:
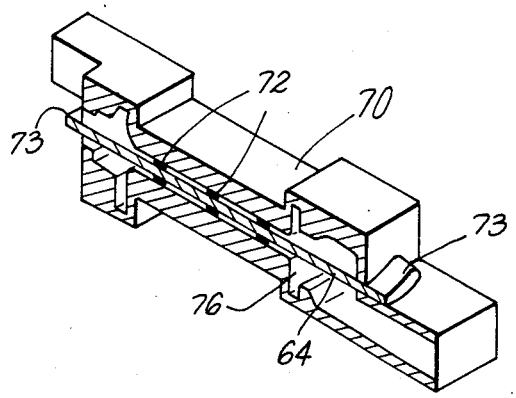

Referring now to FIGS. 5 to 9, there is shown in FIG. 5 a die 70 having a cavity 76 in which is positioned a pre-formed alumina core 64. The internal surfaces of the die are shaped to produce an accurate pattern of the article to be cast, in this example, a stator vane for a gas turbine engine. The core is supported adjacent its ends and edges in the die leaving end and edge portions 73 and 75 exposed, so that they will not be encapsulated by the material being injected into the die.

The core may be pre-fired, in which case its strength may be such that no additional support is necessary. In the preferred method, however, the core is only cured to its "green" state and is preferably also located against movement or distortion during the injection process by high temperature disposable chaplets 72.

The description "high temperature" as applied to the chaplets means, as will be seen later, that they must be made from a material which retains its strength during the firing of the ceramic mould and core up to a temperature at which the ceramic has acquired sufficient strength not to require further support. Beyond that temperature, but at a temperature less than the final sintering temperature of the ceramic, the chaplets must burn out of the finished mould.

It is also preferable that the material used for the chaplets has a shrinkage compatible with that of the ceramic at least up to the self-supporting temperature of the ceramic. One type of material which fulfils all of these requirements is a phenol formaldehyde thermosetting resin containing a graphite filler.

Figure 6:
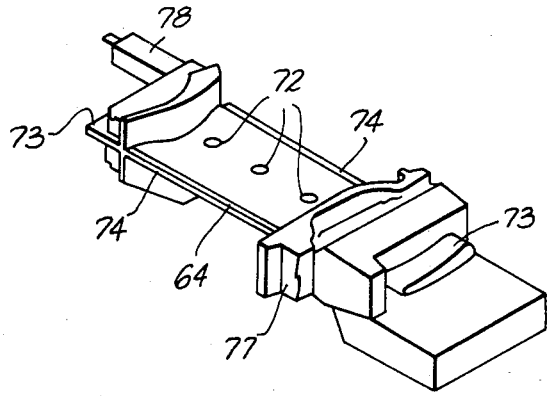

The next step of the method is the injection of the disposable material into the cavity 76, thereby encapsulating the main bulk of the core 64 and the chaplets 72 to form the pattern, but leaving the end and edge portions 73 and 74 of the core exposed. FIG. 6 shows the pattern 77 after removal from the die 70.

Figure 7:
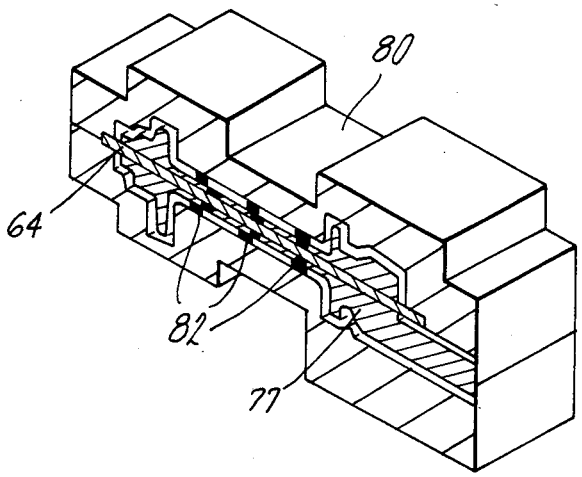

The pattern 77 is then placed in a further die 80, shown in FIG. 7, for the final part of the process, which is the injection of the ceramic material to form the mould. The pattern 77 is supported at its ends, but additional high temperature chaplets 82 are provided along its length to prevent any movement during the injection process. Ceramic material is injected into the space 83 defined within the die by the disposable pattern, and once set into its so-called "green" state the mould is removed from the die.

To allow for differential thermal expansion, all but one of the exposed portions 73 and 74 of the core are painted with a polystyrene paint which burns away during firing of the mould. Thus only one of the embedded portions becomes integrally fixed to the mould, the others remaining free to slide.

Figure 8:
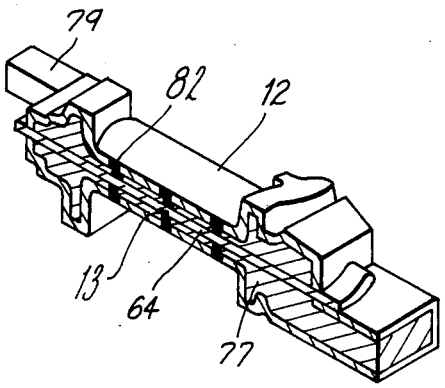

FIG. 8 shows the mould at this stage, and all that remains to be done is to remove the disposable pattern 77 and fire the ceramic and core to produce the finished mould which is shown in FIG. 9.

Depending on the material used as the disposable pattern, it may be removed by melting, burning, dissolution or in any other suitable manner. Where heat is required to remove it, this step of the process may be carried out as part of the firing step. For reasons to be explained below it is preferable that the pattern be removed in a pre-heating step before the mould is fired.

Because the mould walls are thin it is preferable to provide support for them to prevent distortion during the firing step. A preferred manner of doing this is to form an assembly of truncated wedge-shaped spacers, each having a shaped recess in one or both faces thereof into which the moulds are fitted. The recesses are shaped to provide areas of contact at various points along the length of the mould outer surface. When assembled the wedge-shaped spacers may be arranged to define a cylindrical or polygonal assembly.

The spacers should be made of a material which has a shrinkage rate on firing which is compatible with that of the "green" ceramic, and may be made from the same "green" ceramic material.

The firing step is preferably carried out in accordance with the method described in the specification of our copending patent application No. 81,11223 published as British application No. 2096,502 on Oct. 20, 1982. In accordance with that method the cylindrical assembly is bound with a refractory tape which shrinks on heating to a greater degree than the ceramic parts of the assembly. Thus on firing, the tape pulls the truncated wedges tightly together causing the side-faces of the spacers to provide good support for the walls of the mould. The ceramic moulds and cores in their green state have a degree of flexibility and, during the early part of the firing step, any distortions will be straightened out by the pressure from the spacers.

Where the mould is formed with an integral core, as described above, the graphite spacers will support the walls of the mould from inward distortion until the temperature is reached at which they burn out. If the mould is made without a core, however, it is preferable to provide support on the inside of the mould, and this can be done by filling the mould with a non-sintering ceramic powder, for example re-crystallised Alumina, or by supports positioned at different places within the mould cavity. In the latter case, the supports may conveniently be provided by embedding in the disposable pattern, pins made from a high temperature disposable material, for example, the graphite supported resin hereinbefore described. These will remain in place when the disposable material is removed but will burn out before the highest sintering temperature of the ceramic is reached.

Turning now to the materials to be used in the method described above, one of the advantages of the present invention is that it allows a much wider choice for the ceramic material of the mould than the lost wax process. Thus the ceramic material may be a conventional Silica composition or one of the higher strength ceramics, such as Alumina or Zirconia may be used.

The ceramic material is mixed with a resin binder for the injection process. The binder may be a thermo-plastic resin which, on injection into a cold die, sets solid, but which softens again on heating. Using such resins the disposable pattern may be a conventional wax pattern.

In order to take advantage of the benefits of firing the ceramic in a cylindrical assembly, as described above, we prefer to use a thermo-setting resin, which is injected into a hot die and cured. Such resins once cured retain their strength during the early part of the firing process and do not soften again. Of course, a mixture of the two types of resin may be used provided adequate strength is maintained.

When using thermosetting resin binders, the disposable pattern material must be capable of withstanding the temperature and pressure during the injection of the ceramic material without deformation, but must be capable of being removed by a relatively simple process, for example, burning, melting or dissolution. A preferred material is a water soluble organic compound, for example, cane sugar which retains adequate strength to beyond 150° C., which is the usual injection temperature of the ceramic using a thermosetting resin binder.

The cane sugar contains an inert filler such as mica or slate powder, but preferably a soluble filler is used, for example, ammonium chloride and it may contain effervescing agents. Alternatively some low melting point metal alloys may be used, for example, those Tin-Zinc alloys sold under the Trade names of CERROBEND or CERROTRUE.

The chaplets 82 for supporting the pattern 77 in the die 80 must also withstand the pressure and temperature of the injection process. However, since these spacers span the space 83 into which the ceramic is injected, they are preferably made from the same material as the ceramic material being injected but which has previously been cured to its green state. We have found that during the injection process the ceramic integrates with the pieces of the same material cured to the green state to such an extent that the pieces become absorbed into a homogeneous mass without leaving any areas of weakness. These supports thus become part of the mould itself.

The core material need not be alumina but is selected in dependence on the requirements of the casting process. Thus Silica or any other known core material may be used. However, another particular advantage of the invention is that the core and mould can be made from the same ceramic material in the same thermosetting resin binder. When injected hot, the binder cures to the green state which has intermediate strength and some flexibility. The mould with its core and supports can all be fired together at the same temperature and there will be no distortion due to differential thermal expansions or differential shrinkage. Thus the core remains accurately positioned within the final mould.

The high temperature chaplets 82 may, as an alternative to the graphite compound, be made from a metal compatible with that being cast, and which can be allowed to dissolve in the casting rather than being burned out as the graphite spacers are.

It will be appreciated that the above-described process enables a core to be accurately located in a mould which is itself made by a transfer moulding technique, so that none of the accuracy provided by the injection process of mould manufacture is lost.

One advantage of the above-described process over the conventional lost wax process is that the ceramic from which the mould is made can be accurately injected to give a very thin homogeneous wall thickness. This enables high heat conductivity to be achieved which speeds up the cooling process after casting. The homogeneous material is of uniform cross-section and is not subject to flaking or cracking as is the conventional invested shell mould. Because of the choice of materials available with this process, a material having the most beneficial combination of strength and thermal conductivity can be chosen depending on the casting process being used. Clearly the mould can have a varying wall thickness if desired.

In order to make a mould without a core, the process is simplified by the elimination of the first step. A disposable article is made without the core and is supported in a die as described above while ceramic is injected around it.

The mould shown in the example described above is open-ended ready for connection to the runner system.

In the completed assembly the ceramic tubes 18 inserted into the hollow support 79, into which they are sealed by a ceramic sealant, and pass with a sliding clearance through apertures in the pouring cup 19.

Thus it can be seen that a completely fabricated assembly can be made from accurately transfer moulded parts and wherein all the parts are inspectable and replaceable, if defective, at any stage in the process. The thickness of the individual parts can be varied depending on whether handling strength or high heat conductivity are needed, and all parts can be mechanically locked together. All that remains to finish off the assembly is to apply a thin coating of ceramic sealant around the joint areas to prevent leakage of molten metal during pouring.

The assembly may form a single large mould for casting one large component, and the individual parts would then be sections of the large mould.

I claim:

1. A method for the manufacture of a ceramic mould assembly for casting directionally solidified articles, the components of such assembly including a runner and riser system connected to at least one thin-walled mould, comprising the steps of:

separately injection moulding the components of the assembly, providing features on the components which form or co-operate with interengageable mechanical locking means to hold the separate components of the assembly together, forming joints between the components of the assembly with the interengageable locking features in engagement to lock the components of the assembly together, and sealing the joints of the assembly by applying a coating of a ceramic sealant.

2. A method as claimed in claim 1 and wherein at least one of said components defines a runner downpole for the assembly.

3. A method as claimed in claim 2 and in which at least one of said components defines a starter base portion which includes a runner system for the assembly which connects the runner downpole with the casting cavity defining components.

4. A method as claimed in claim 1 and wherein the mechanical locking features on at least some of the components are in the form of interengageable screw threads.

5. A method as claimed in claim 1 and wherein the mechanical locking features on at least some of the components are in the form of the interengageable projections and recesses of a bayonet fitting.

6. A method as claimed in claim 1 and wherein the casting moulds are formed as thin-walled seamless moulds by transfer moulding ceramic material in a resin binder in a die containing a disposable pattern.

7. A method as claimed in claim 6 and including the further step of providing a ceramic core within the disposable pattern, prior to the transfer moulding step, whereby a mould is produced with a core integrally fixed within it for casting hollow articles.

8. A method as claimed in claim 7 and wherein the ceramic core is made from the same material as the mould material in its green state and the core and mould are fired together to sinter the ceramic.

9. A ceramic mould assembly for casting directionally solidified articles, the components of such assembly including a runner and riser system connected to at least one thin-walled mould, the assembly being made by a method comprising the steps of:

separately injection moulding the components of the assembly, providing features on the components which form or co-operate with interengageable mechanical locking means to hold the separate components of the assembly together, forming joints between the components of the assembly with the interengageable locking features in engagement to lock the components of the assembly together, and sealing the joints of the assembly by applying a coating of a ceramic sealant.

10. A mould assembly according to claim 9 and wherein the base component defines a space for insertion of a chill block and includes mechanical locking means arranged to co-operate with further mechanical locking means on the chill block for locking the chill block into the runner system component.

* * * * *